US007669301B2

(12) United States Patent
Catallo

(10) Patent No.: US 7,669,301 B2
(45) Date of Patent: Mar. 2, 2010

(54) MODULAR TENTER FRAME RAIL

(76) Inventor: Frank Catallo, 84 Wheatley Rd., Old Westbury, NY (US) 11568

( * ) Notice: Subject to any disclaimer, the term of this patent is extended or adjusted under 35 U.S.C. 154(b) by 524 days.

(21) Appl. No.: 11/637,461

(22) Filed: Dec. 11, 2006

(65) Prior Publication Data

US 2008/0134481 A1 Jun. 12, 2008

(51) Int. Cl.
*D06C 3/02* (2006.01)

(52) U.S. Cl. ..... 26/89; 26/92; 26/96

(58) Field of Classification Search ..... 26/89, 26/91, 96, 73, 98, 93–95, 52, 71, 72, 80, 26/81, 83, 92; 266/170, 172, 173; 425/66; 34/658, 659, 660, 662; 198/583, 584, 586, 198/587, 860.2, 860.3, 860.5, 861.2, 861.6
See application file for complete search history.

(56) References Cited

U.S. PATENT DOCUMENTS 820,746 A * 5/1906 Taylor ..... 26/93
1,732,089 A * 10/1929 Honeyman, Jr. et al. ..... 26/91
1,746,473 A * 2/1930 Hoey ..... 26/52
3,430,310 A * 3/1969 Richbourg ..... 26/51.3
3,571,846 A * 3/1971 Tomlinson ..... 26/91
3,598,371 A * 8/1971 Hyatt ..... 26/91
4,080,692 A * 3/1978 Parrillo et al. ..... 26/91
4,497,096 A * 2/1985 Richter ..... 26/74
4,817,254 A * 4/1989 Poterala ..... 26/51.3
4,882,820 A * 11/1989 MacKinnon et al. ..... 26/93
5,862,574 A * 1/1999 Poterala ..... 26/89
7,073,237 B1 * 7/2006 Cavanagh ..... 26/89
2005/0236456 A1 * 10/2005 Lee ..... 226/174

* cited by examiner

*Primary Examiner*—Amy B Vanatta
(74) *Attorney, Agent, or Firm*—Charles E. Baxley

(57) ABSTRACT

A modular tenter frame for guiding a pair of chains with pins through a predetermined path to transport an open width tubular knit web through a drying oven and/or a steaming station to a compressive treating station to improve quality of the open width tubular knit web. The frame includes a rail section. The rail section guides an associated chain with the pins through the predetermined path to transport the open width tubular knit web through the drying oven and/or the steaming station to the compressive treating station to improve the quality of the open width tubular knit web. The rail section has a pair of recessed tracks being longitudinal, facing in a same direction, being spaced-apart from each other by a space therebetween defined by a web, and receiving the chains.

25 Claims, 9 Drawing Sheets

MODULAR TENTER FRAME RAIL

1. BACKGROUND OF THE INVENTION

A. Field of the Invention

The embodiments of the present invention relate to a tenter frame rail, and more particularly, the embodiments of the present invention relate to a modular tenter frame rail.

B. Description of the Prior Art

In the process of finishing textile goods that are knit either completely or partially from synthetic materials, the goods are processed through a tenter frame where they are raised to a temperature sufficiently high to cause the material to be in a plastic state. The tenter hooks or pins on the frame fix the mechanical dimensions of the material and the process thus "sets" the material to that dimension.

Flexible sheet materials, such as lengths of fabric, are customarily dried or relaxed on these tenter frames. In a common form of these frames, the continuously advancing sheet is pressed by cylindrical brushes upon moving parallel rows of pins along each selvedge so that the sheet is held under lateral restraint as it is heated or subjected to other desired treatment as it is passed through the apparatus.

Conventional tenter frames are usually designed to dry and stretch a fabric web to its finished width, and include a pair of laterally spaced, elongate, and longitudinally movable first and second chains gripping the selvages or edges of the fabric web and advancing the web through a heating chamber. The chains slightly diverge during their advance through the heating chamber so as to apply lateral tension to the web as it advances therethrough.

Tenter frame chains with tentering clamp and needle combination links are used in horizontal hot air tentering frames. These chains also enable a further standardization of the guiding of the chains in single layer tenter frames. A typical tenter frame generally includes a plurality of tenter frame clips mounted on two endless chains guided by a pair of diverging tracks. The clips are adapted to shift from an open position to a closed position to grip the edges of a web of material, such as plastic film. As the web is moved in the machine direction being gripped by the clips that are moving on the diverging tracks, the web can be stretched transversely simultaneous with its longitudinal movement.

Tenter frame chains equipped with tentering clamp and needle combination links utilize so-called hammer-type tentering clamps for the clamping action, which have the drawback that their clamping action is limited and that an exact clamping width is not certain as is the case with the so-called roller probing tentering devices.

In the general operation of tenter frames, a web material enters the machine at one end where the web is engaged along its edges or selvages by a series of upwardly extending pins penetrating the web material. The pins are in turn secured to and supported by two endless tenter chains. The web material is thus held along its opposite edges by the upwardly extending pins for the full period of web travel through the tenter frame where it may be subjected to various and sundry treatments. For example, where the web material is a knitted or a woven fabric, it may simply be washed, shrunk, or stretched as desired and maintained in a desired dimensional state by the tenter chains as it dries. In any event, as web material moves through the tenter frame and reaches the exit end it becomes necessary to remove the web from the pins on the tenter chains for ultimate removal of the web from the tenter. At the same time in processing many web materials, it is necessary to trim the edges or selvages of the web material to remove the portion having been penetrated by the pins on the tenter chains. Otherwise a defect may be created in the web. Other webs, however, are unaffected by the pin holes and no trimming is necessary.

Numerous innovations for tenter frames and related devices have been provided in the prior art that will be described below, which are in chronological order to show advancement in the art, and which are incorporated herein by reference thereto. Even though these innovations may be suitable for the specific individual purposes to which they address, they each differ in structure, and/or operation, and/or purpose from the embodiments of the present invention in that they do not teach a modular tenter frame rail.

(1) U.S. Pat. No. 3,961,425 to Swanson et al.

U.S. Pat. No. 3,961,425 issued to Swanson et al. on Jun. 8, 1976 in class 34 and subclass 447 teaches an automatic temperature control system for a textile tenter frame having an oven section for heating the fabric in order to "set" its fibers in an essentially non-shrinkable state. The system operates to maximize the speed of the tenter frame while maintaining optimum heat set conditions. Fabric temperature from within the oven and initial moisture content data are furnished to a computer and processed with time-at-temperature target inputs to provide tenter frame speed control output signals.

(2) U.S. Pat. No. 4,017,722 to Swanson.

U.S. Pat. No. 4,017,722 issued to Swanson on Apr. 12, 1977 in class 700 and subclass 130 teaches a method and an apparatus for controlling the yield of fabric material from a tenter frame having spaced apart belts driven by drive apparatus and an overfeed roll at its entry end. In a start-up or style change mode of operation, a predicted dry yield is computed from data signals received before the fabric enters the tenter frame and is then compared with a target value to produce a control signal to the overspeed roll. In the steady state mode of operation, actual yield is computed from data taken at the output end of the tenter frame and is then is compared with a target yield value and thereafter modified by a correction factor proportional to variations in predicted dry yield computed from inputs taken at the entry to the tenter frame. The modified control signal again is applied to the overspeed roll.

(3) U.S. Pat. No. 4,065,838 to Jungpeter et al.

U.S. Pat. No. 4,065,838 issued to Jungpeter et al. on Jan. 3, 1978 in class 26 and subclass 94 teaches a device for opening tenter frame clips mounted on an endless chain carried by a sprocket wheel including a clip opening wheel rotatable on a common axis with the sprocket wheel. The clip opening wheel has an elastomeric peripheral rim. The clips have apparatus including a clamping surface and a pivotable clamping arm for clamping a web of material therebetween. The clamping arm is connected to a clip opening arm for pivoting the clamping arm into its open position. The clip opening arm is adapted to contact the elastomeric peripheral rim of the clip opening wheel as the clips are moved by the chain to open the clips. The elastomeric rim is of a material, such as polyurethane rubber having a hardness of 95 Shore A, reducing impact force as the opening arm is moved into contact with the rim during the opening of the clip. The rim may be fixedly mounted on the periphery of the wheel. Alternatively, the rim may move freely with respect to the wheel or the wheel may be freely rotatable about the common axis independently of the sprocket to help spread wear around the full circumference of the wheel.

(4) U.S. Pat. No. 4,232,434 to Pfister.

U.S. Pat. No. 4,232,434 issued to Pfister on Nov. 11, 1980 in class 26 and subclass 86 teaches an apparatus for supplying and attaching stiff crimpable sheet material at its selvedges to pin chains of a tenter frame, including overfeed apparatus for squeezing the material at each selvedge into a wavy shape and a pinning brush having a peripheral surface corresponding to the wavy shape of the selvedge of the material. The pinning brush synchronously moves with the selvedge of the material so that the crests and valleys of the peripheral surface of the brush are maintained in alignment with valleys and crests, respectively, of the selvedge.

(5) U.S. Pat. No. 4,403,379 to Grafen.

U.S. Pat. No. 4,403,379 issued to Grafen on Sep. 13, 1983 in class 26 and subclass 95 teaches a chain for a tentering frame, including links carrying so-called tentering hooks and needles for holding a fabric web to a movable conveyor forming the tentering frame. Each link carries an intermediate support member holding at its free end a journal pin below the margin of a fabric web. The journal pin supports an arched bail in a tiltable manner for movement between a working position and a rest position. The bail carries at its upper free end a further journal pin supporting a tentering hook in a tiltable manner. The first journal pin further supports a needle bar being tiltable with its needles into a fabric penetrating position or into an inoperative position. The needle bar preferably has a flat surface cooperating with the tentering hooks as a counter-holder when the needles are in a rest position.

(6) U.S. Pat. No. 4,497,096 to Richter.

U.S. Pat. No. 4,497,096 issued to Richter on Feb. 5, 1985 in class 26 and subclass 74 teaches a tenter frame drive wherein auxiliary power operated apparatus drives the sprockets at the entrance end of the chain runs, opposite the main drive at the exit end. The auxiliary drives remove the slack in the chains normally occurring at the exit end opposite the point of driving engagement of the sprockets in such a fashion as to avoid chattering of the chain and tenter clips while providing for a division of the forces so as to some extent reduce maximum tension in the chain and at the same time insure sufficient tension for proper gripping of the web at the entrance end of the tenter.

(7) U.S. Pat. No. 4,658,482 to Lechner.

U.S. Pat. No. 4,658,482 issued to Lechner on Apr. 21, 1987 in class 26 and subclass 93 teaches a tenter frame clip wherein the metal-to-metal contact between the clamping arm and the clip body is cushioned by elastomeric material. The cushioning material can be located on the clip body at the point of contact with the arm or on a rocker member hinged to the arm and located beneath a strike plate attached to the body.

(8) U.S. Pat. No. 4,788,756 to Leitner, Sr.

U.S. Pat. No. 4,788,756 issued to Leitner, Sr. on Dec. 6, 1988 in class 26 and subclass 51.4 teaches an apparatus and a method for correcting bow distortions in a fabric web during a tentering operation, including tension applying apparatus at each of the entry and exit ends of the tenter frame so that a tension is applied at each of the respective opposite ends of the tenter, with the applied tensions being directed in opposite directions. A sensor is for detecting either a leading or a trailing bow in the advancing web, and a control system acts in response to a signal from the sensor to change the tension applied at one or both ends of the tenter frame and thereby straighten the bow.

(9) U.S. Pat. No. 4,882,820 to MacKinnon et al.

U.S. Pat. No. 4,882,820 issued to MacKinnon et al. on Nov. 28, 1989 in class 26 and subclass 93 teaches a tenter frame chain including a plurality of links, each link including upper and lower interconnected loadbearing plates, and a low friction slide block sandwich between the upper and lower interconnected plates. The slide block is formed of material having a lower coefficient of friction than the interconnected loadbearing plates and includes a vertically disposed bearing surface located laterally outwardly beyond the lateral extent of one side of the upper and lower interconnected loadbearing plates. The vertically disposed bearing surface of the slide block contacts the bearing surface of the guide rail to reduce the frictional rubbing movement of the tenter chain against the vertically disposed bearing surface of each of the tenter chain guide rails as the tenter chain moves therealong.

(10) U.S. Pat. No. 4,926,529 to Hosmer et al.

U.S. Pat. No. 4,926,529 issued to Hosmer et al. on May 22, 1990 in class 26 and subclass 89 teaches a tenter frame wherein a chain is fabricated by press fitting a pin-receiving bushing constructed of Vespel and the like into a steel bushing and then boring a pin-receiving opening therein and utilizing wear strips constructed of Vespel in a dovetail configuration opposite the tenter chain providing a lubrication free tenter wherein the chain may be tensioned without excessive stretching.

(11) U.S. Pat. No. 4,939,825 to Kwack.

U.S. Pat. No. 4,939,825 issued to Kwack on Jul. 10, 1990 in class 26 and subclass 93 teaches a tenter frame clip being at least partially constituted from a lightweight polymeric composite material. The clips are employed in tenter frames as components of clip-chain assemblies for grippingly engaging and advancing thermoplastic film webs, fabrics, or foils through the tenter frame as the web is concurrently transversely stretched, and for the most part, are generally constituted from either cast iron or cast steel depending upon the type and size of the tenter frame and which may each readily weigh as much as five pounds and even higher. Each clip is able to exert a gripping force of up to 1500 to 2500 pounds.

(12) U.S. Pat. No. 4,972,560 to Baum.

U.S. Pat. No. 4,972,560 issued to Baum on Nov. 27, 1990 in class 26 and subclass 96 teaches an apparatus for a tenter frame feeding a fabric web to the nip region of vertical pins and cooperating rollers of a pair of endless belt assemblies transporting the web through a drying chamber. The apparatus includes a guide member guiding the web into the nip at a relatively steep angle, preferably in the range of 30° to 60°. The guide member can be supported on a pair of swivel supports, each of the swivel supports being movably supported on one of the endless belt assemblies. Additionally, the guide member can be a roller rotatable about its axial length, which can be rotated in synchronization with the feed of the web.

(13) U.S. Pat. No. 5,051,225 to Hommes et al.

U.S. Pat. No. 5,051,225 issued to Hommes et al. on Sep. 24, 1991 in class 264 and subclass 288.4 teaches an apparatus and a method for producing a drawn film by propelling individual carriages along opposed loops from a first speed abutted in stacks in carriage collection sections to a second speed space apart in a drawing section of a tenter frame and to a third speed in stack forming sections where the carriages return to the first speed in the stacks. First primaries positioned adjacent one part of each loop develop electromagnetic waves for engaging synchronous secondaries attached to active carriages to provide controlled spacing of the carriages and second primaries adjacent another part of the loop develop other electromagnetic waves for engaging hysteresis secondaries attached to active and to passive carriages to provide controlled abutting of the carriages.

(14) U.S. Pat. No. 5,067,214 to Hosmer et al.

U.S. Pat. No. 5,067,214 issued to Hosmer et al. on Nov. 26, 1991 in class 26 and subclass 89 teaches a tenter frame wherein a chain is fabricated by press fitting a pin-receiving bushing constructed of Vespel and the like into a steel bushing and then boring a pin-receiving opening therein and utilizing wear strips constructed of Vespel in a dovetail configuration opposite the tenter chain providing a lubrication free tenter wherein the chain may be tensioned without excessive stretching. Also, are lubrication-free tenter-clip jaw pivot bushings.

(15) U.S. Pat. No. 5,072,493 to Hommes et al.

U.S. Pat. No. 5,072,493 issued to Hommes et al. on Dec. 17, 1991 in class 26 and subclass 72 teaches an apparatus and a method for producing a drawn film by propelling individual carriages along opposed loops from a first speed abutted in stacks in carriage collection sections to a second speed space apart in a drawing section of a tenter frame and to a third speed in stack forming sections where the carriages return to the first speed in the stacks. First primaries positioned adjacent one part of each loop develop electromagnetic waves for engaging synchronous secondaries attached to active carriages to provide controlled spacing of the carriages and second primaries adjacent another part of the loop develop other electromagnetic waves for engaging hysteresis secondaries attached to active and to passive carriages to provide controlled abutting of the carriages.

(16) U.S. Pat. No. 5,081,751 to Pettigrew.

U.S. Pat. No. 5,081,751 issued to Pettigrew on Jan. 21, 1992 in class 26 and subclass 91 teaches an apparatus for limiting movement of tenter frame rails in order to avoid damage, particularly to chains, resulting from excessive movement, including a spring-biased plunger valve carried by the rail on one side of a rail junction, while the other side of the junction carries a member having a predetermined surface for actuating a switch when the member moves to an extreme position where it can no longer support the plunger against the resilient force of the spring causing a switch to be activated to deactivate the motor imparting transverse movement to the rails.

(17) U.S. Pat. No. 5,373,613 to Young, Jr. et al.

U.S. Pat. No. 5,373,613 issued to Young, Jr. et al. on Dec. 20, 1994 in class 26 and subclass 96 teaches a tenter frame for treating web materials, such as woven or knitted fabrics, film, or the like, to apparatus for removing a web from a tenter while controlling the web, and to a process for removal of a web from a tenter. A pair of endless-opposed tenter chains having a plurality of pins thereon engage opposite edges of the web material for holding it as it is treated on the tenter frame. Pinned rolls are provided for engaging and transferring the web material from the pins of the tenter frame, with the web taken off of the tenter chains without loss of control over the web. A cutter unit is for trimming the edges from the web after it has been removed from the tenter chain and while the web remains under control of the pinned rolls, after which trimmed edges are automatically removed from the pins for discarding.

(18) U.S. Pat. No. 5,416,959 to Forrest, Jr.

U.S. Pat. No. 5,416,959 issued to Forrest, Jr. on May 23, 1995 in class 26 and subclass 73 teaches a tenter clip for gripping a web of thermoplastic film between the curved surface of a toggle arm and an anvil surface being tapered at each of its ends. The surface configurations of the toggle arm and anvil define effective surfaces for gripping the film while allowing the film to stretch under these surfaces. Beads are formed at the edges of the web during stretching. These beads wedge into substantially V-shaped gripping regions defined by the toggle arm and the anvil to assist in the stretching operation.

(19) U.S. Pat. No. 5,438,941 to Henz et al.

U.S. Pat. No. 5,438,941 issued to Henz et al. on Aug. 8, 1995 in class 112 and subclass 90 teaches an embroidery machine having horizontally parallel fabric shafts for a vertically arranged embroidery fabric. A plurality of upper and lower horizontal guides are distributed over the length of the machine. One upper and one lower horizontal guide are each connected to a horizontal guide element by vertical connection elements. The horizontal guide elements and the fabric shafts each are vertically adjustable by a positioning drive in guides mounted on the machine.

(20) U.S. Pat. No. 5,555,610 to Young, Jr. et al.

U.S. Pat. No. 5,555,610 issued to Young, Jr. et al. on Sep. 17, 1996 in class 26 and subclass 93 teaches a tenter frame for treating web materials, such as woven or knitted fabrics, film, or the like, to apparatus for removing a web from a tenter while controlling the web, and to a process for removal of a web from a tenter. A pair of endless-opposed tenter chains having a plurality of pins thereon engage opposite edges of the web material for holding it as it is treated on the tenter frame. Pinned rolls are provided for engaging and transferring the web material from the pins of the tenter frame, with the web taken off of the tenter chains without loss of control over the web. A cutter unit is for trimming the edges from the web after it has been removed from the tenter chain and while the web remains under control of the pinned rolls, after which trimmed edges are automatically removed from the pins for discarding.

(21) U.S. Pat. No. 5,797,172 to Hosmer.

U.S. Pat. No. 5,797,172 issued to Hosmer on Aug. 25, 1998 in class 26 and subclass 89 teaches a tenter frame apparatus including an endless chain for carrying tenter clips on one side of a monorail or positioning a web for transport on a single pair of longitudinally aligned bearings carried in horizontal alignment with the web and for guidance on a stationary track by a wear strip first-opposed wear pads opposite the bearings and second-opposed wear pads at the top of the monorail. Since the bearings do not engage drive sprockets at turnarounds, impact and high loads are avoided. In some applications wear strips may be substituted for the bearings.

(22) U.S. Pat. No. 5,862,574 to Poterala.

U.S. Pat. No. 5,862,574 issued to Poterala on Jan. 26, 1999 in class 26 and subclass 89 teaches a tenter frame including low-profile rail assemblies for carrying an endless carrier. A series of attachment blocks of the endless carrier have tentering connectors for transporting a sheet material under widthwise tension in a longitudinal path through the tenter machine. Each rail assembly has guideways for supporting and carrying an endless carrier within the guideways. The tentering system uses a plurality of spherical bearing balls for transporting the endless carrier within slots of the guideways. The endless carrier includes an endless belt or endless chain connecting a series of attachment blocks for holding the bearing balls in a position so that they can freely rotate within the guideways. Tentering connectors are carried by the attachment blocks of the endless carrier for supporting spaced-apart edges of the sheet material. The endless carrier is driven by spaced drive wheels in a closed-loop path to carry the sheet material along the longitudinal path through the tenter machine. A transition guideway section, formed with a plurality of adjacent bending contour plates, provides for angular transitions when connecting together entry, stretch, intermediate, and delivery guideways of rail assemblies. And, a vertically operated closed-loop endless carrier is driven by vertical drive wheels.

(23) U.S. Pat. No. 7,073,237 to Cavanagh.

U.S. Pat. No. 7,073,237 issued to Cavanagh on Jul. 11, 2006 in class 26 and subclass 89 teaches a joint for articulately interconnecting the adjacent ends of rail assemblies in a tenter frame. The rail assemblies are arranged consecutively along a guide path and have parallel guide channels for the advancing and returning legs of continuous chains carrying the clamps gripping the edges of the webs being transversely stretched. The joint includes flexible bands arranged to define intermediate channels connecting the guide channels of the rail assemblies. The flexible bands are resiliently deflected in response to articulation of the rail assemblies to thereby arcuately configure the outer medicate channels.

It is apparent that numerous innovations for tenter frames and related devices have been provided in the prior art that are adapted to be used. Furthermore, even though these innovations may be suitable for the specific individual purposes to which they address, they would not be suitable for the purposes of the embodiments of the present invention as heretofore described, namely, a modular tenter frame rail.

2. SUMMARY OF THE INVENTION

Thus, an object of the embodiments of the present invention is to provide a modular tenter frame rail that avoids the disadvantages of the prior art.

Briefly stated, another object of the embodiments of the present invention is to provide a modular tenter frame for guiding a pair of chains with pins through a predetermined path to transport an open width tubular knit web through a drying oven and/or a steaming station to a compressive treating station to improve quality of the open width tubular knit web. The frame includes a rail section. The rail section guides an associated chain with the pins through the predetermined path to transport the open width tubular knit web through the drying oven and/or the steaming station to the compressive treating station to improve the quality of the open width tubular knit web. The rail section has a pair of recessed tracks being longitudinal, facing in a same direction, being spaced-apart from each other by a space therebetween defined by a web, and receiving the chains.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

Figure 1A:
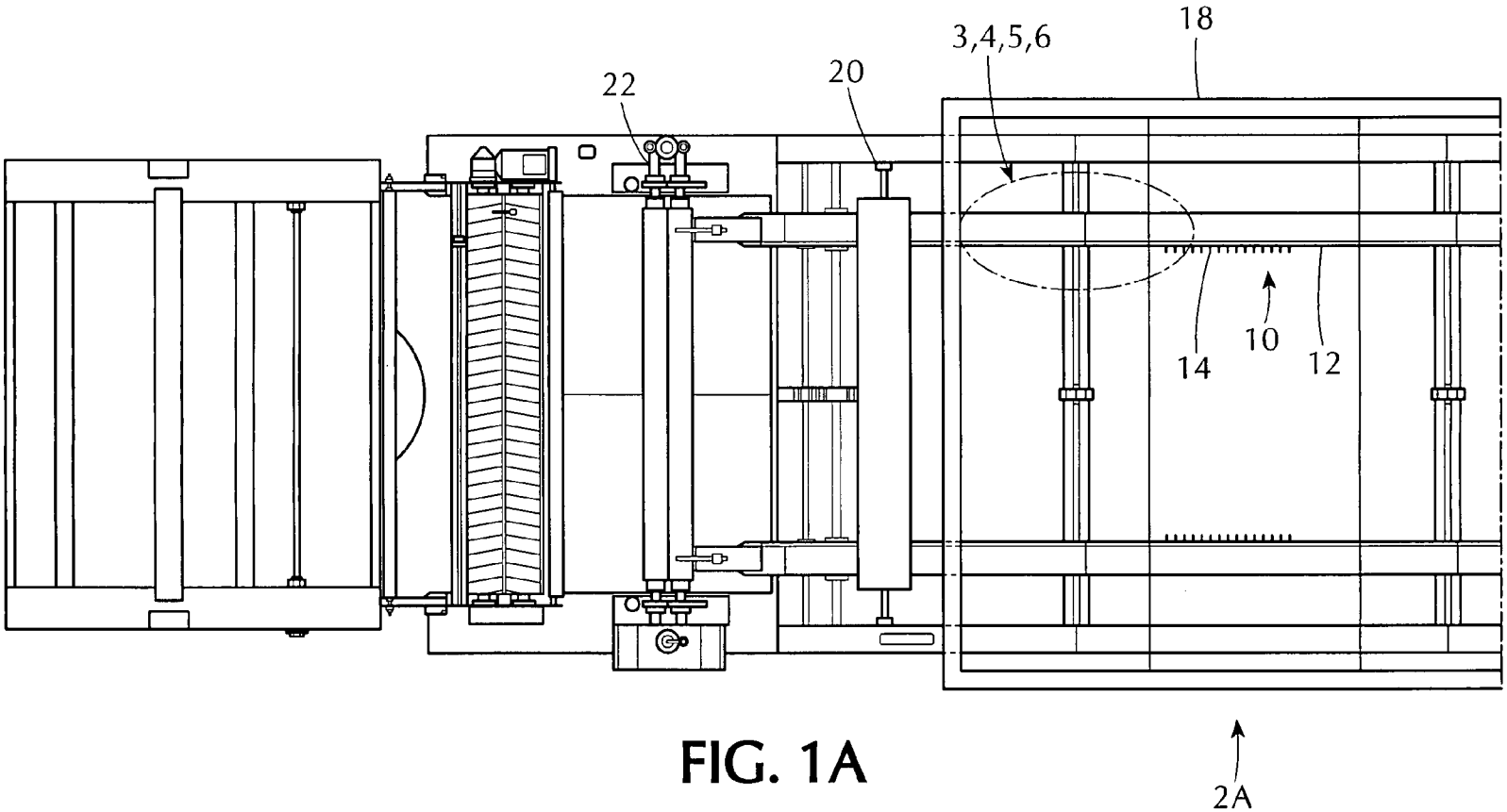
FIGS. 1A-1B are a diagrammatic top plan view of a tenter frame utilizing the modular tenter frame rail of the embodiments of the present invention transporting an open width tubular knit web through a drying oven and a steaming station to a compressive treating station to improve quality of the web.

A. General.

10 modular tenter frame rail of embodiments of present invention for guiding pair of chains 12 with pins 14 through predetermined path to transport open width tubular knit web 16 through drying oven 18 and/or steaming station 20 to compressive treating station 22 to improve quality of open width tubular knit web 16

12 pair of chains

14 pins of pair of chains 12

16 open width tubular knit web

18 drying oven

20 steaming station

22 compressive treating station

B. Configuration of Rail Section 24.

24 rail section for guiding associated chain 12 with pins 14 through predetermined path to transport open width tubular knit web 16 through drying oven 18 and/or steaming station 20 to compressive treating station 22 to improve quality of open width tubular knit web 16

28 pair of recessed tracks in rail section 24

30 space in rail section 24

31 web defining space 30 in rail section 24

32 connecting member

34 inverted U-channel of connecting member 32

36 hinge member

38 cover member

40 inverted U-channel of cover member 38

C. Configuration of Pinning Brush Assembly 42.

42 pinning brush assembly

44 first sprocket chain of pinning brush assembly 42

46 pins of pinning brush assembly 42 for engaging associated edge of open width tubular knit web 16

48 bracket of pinning brush assembly 42

50 motor of pinning brush assembly 42
52 right angle gearing of pinning brush assembly 42
54 first sprocket gear of pinning brush assembly 42
56 second sprocket gear of pinning brush assembly 42
58 second sprocket chain of pinning brush assembly 42
60 third sprocket gear of pinning brush assembly 42
62 jack shaft of pinning brush assembly 42
64 fourth sprocket gear of pinning brush assembly 42
66 brush shaft of pinning brush assembly 42
67 ball bearings of pinning brush assembly 42
68 third sprocket chain of pinning brush assembly 42
70 rubber-covered pinning wheel of pinning brush assembly 42
71 hub of rubber-covered pinning wheel 70 of pinning brush assembly 42
72 brush arm of pinning brush assembly 42
74 handle of pinning brush assembly 42
75 ball plunger of pinning brush assembly 42
76 support of pinning brush assembly 42
77 spring plunger bracket of pinning brush assembly 42
78 subplate of pinning brush assembly 42
79 detent stop of pinning brush assembly 42
80 guard mounting bracket of pinning brush assembly 42
82 guard of pinning brush assembly 42
84 end cover of pinning brush assembly 42

5. DETAILED DESCRIPTION OF THE PREFERRED EMBODIMENTS

A. General.

Figure 1B:
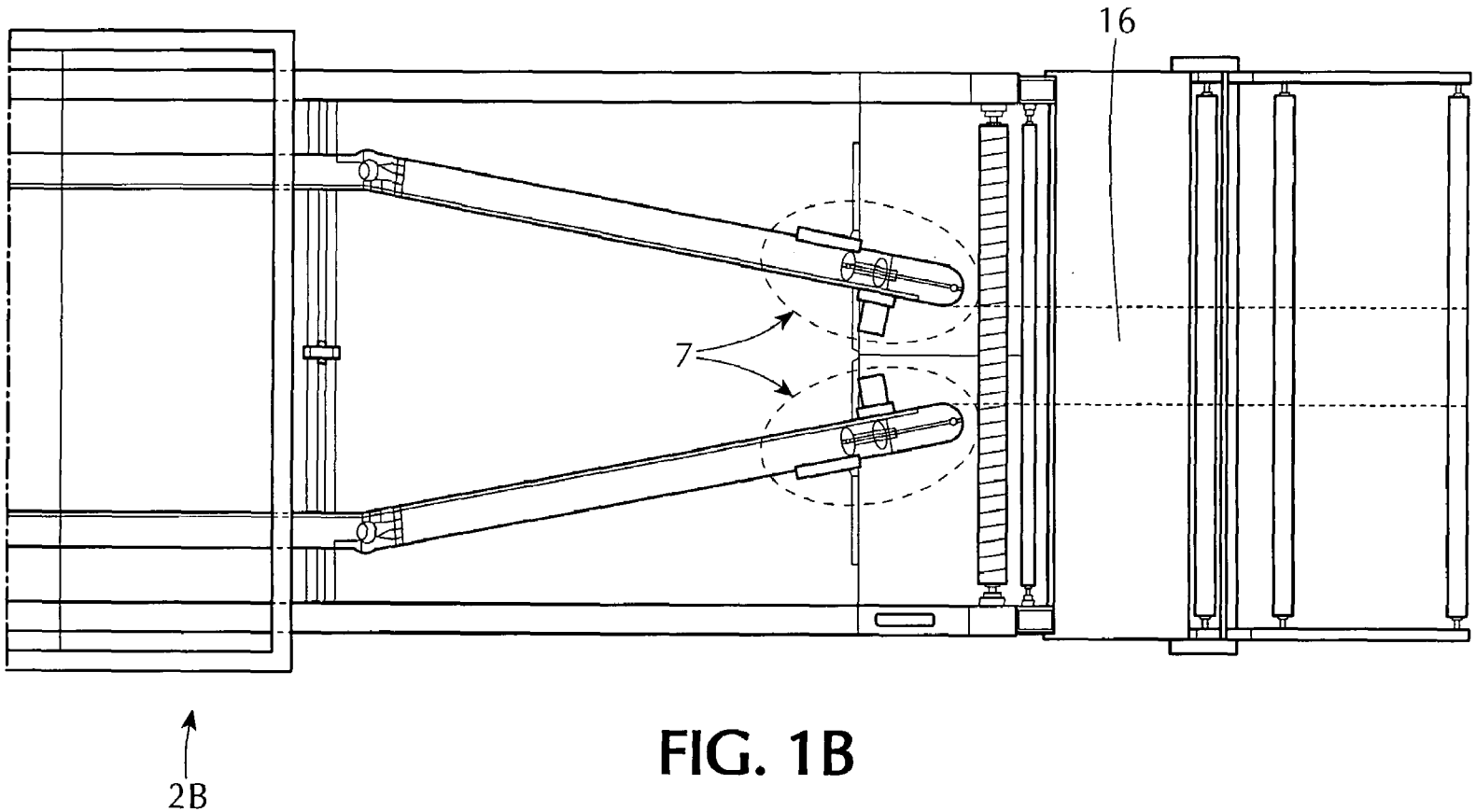
Figure 2A:
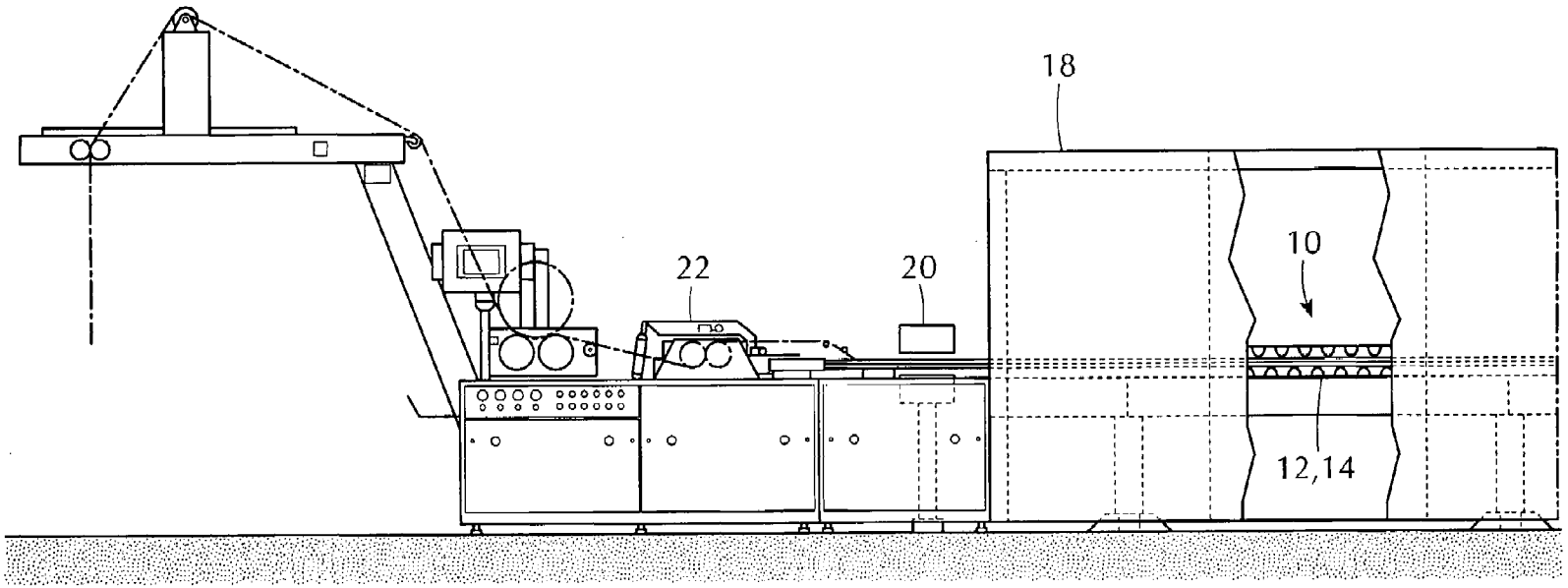
FIGS. 2A-2B are a diagrammatic side elevational view taken generally in the direction of ARROWS 2A and 2B in FIGS. 1 and 2, respectively.
Figure 2B:
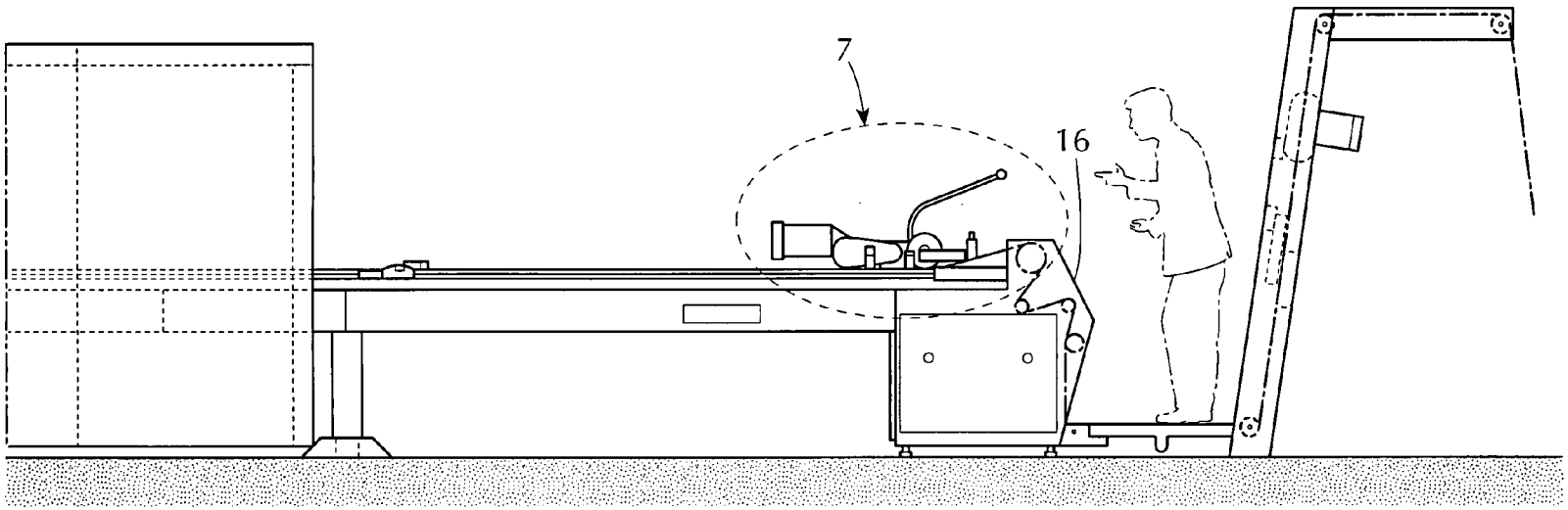

Referring now to the figures, in which like numerals indicate like parts, and particularly to FIGS. 1A-1B and 2A-2B, which are, respectively, a diagrammatic top plan view of a tenter frame utilizing the modular tenter frame rail of the embodiments of the present invention transporting an open width tubular knit web through a drying oven and a steaming station to a compressive treating station to improve quality of the web, and a diagrammatic side elevational view taken generally in the direction of ARROWS 2A and 2B in FIGS. 1 and 2, respectively, the modular tenter frame rail of the embodiments of the present invention is shown generally at 10 for guiding a pair of chains 12 with pins 14 through a predetermined path to transport an open width tubular knit web 16 having edges and a width through a drying oven 18 and/or a steaming station 20 to a compressive treating station 22 to improve quality of the open width tubular knit web 16.

B. The Configuration of the Rail Section 24.

The configuration of the modular tenter frame rail 10 can best be seen in FIGS. 3-6, and as such, will be discussed with reference thereto.

Figure 3:
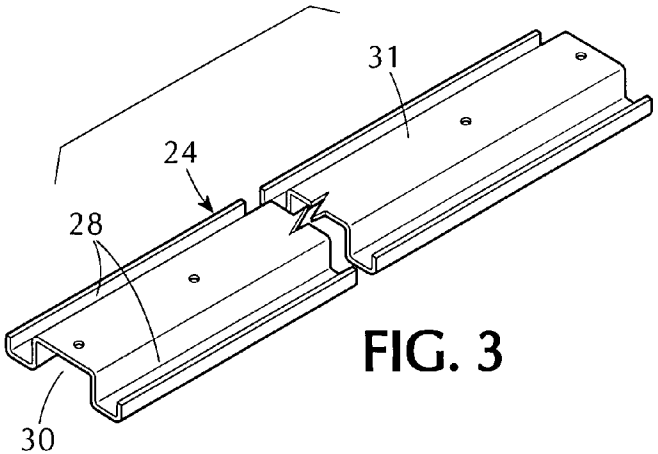
FIG. 3 is a diagrammatic perspective view of the area generally enclosed by the dotted curve identified by ARROW 3 in FIG. 1A of a rail section of the modular tenter frame of the embodiments of the present invention.

As shown in FIG. 3, which is a diagrammatic perspective view of the area generally enclosed by the dotted curve identified by ARROW 3 in FIG. 1A of a rail section of the modular tenter frame of the embodiments of the present invention, the modular tenter frame rail 10 comprises a rail section 24.

The rail section 24 is for guiding an associated chain 12 with the pins 14 through the predetermined path to transport the open width tubular knit web 16 through the drying oven 18 and/or the steaming station 20 to the compressive treating station 22 to improve the quality of the open width tubular knit web 16.

The rail section 24 is a plate made out of steel or similar material, and is a relatively short section joined to other rail sections 24 end-to-end to form a continuous track as long as required.

The rail section 24 has a pair of recessed tracks 28. The pair of recessed tracks 28 in the rail section 24 are longitudinal, face a same direction, and are spaced-apart from each other by a space 30 defined by a web 31.

The pair of recessed tracks 28 in the rail section 24 are of suitable widths for first guiding the chain 12 in one direction and then guiding the chain 12 in another direction being opposite to the one direction.

The space 30 between the pair of recessed tracks 28 in the rail section 24 is longitudinal and recessed in a direction opposite to that of the pair of recessed tracks 28 in the rail section 24 for permitting, for example, air nozzles in the drying oven 18 to be placed top and bottom of the rail section 24 in close proximity to the rail section 24 to effectively blow hot air on both sides of the open width tubular knit web 16 carried by the chain 12 traveling in an associated recessed track 28 in the rail section 24 for efficient drying.

Figure 4:
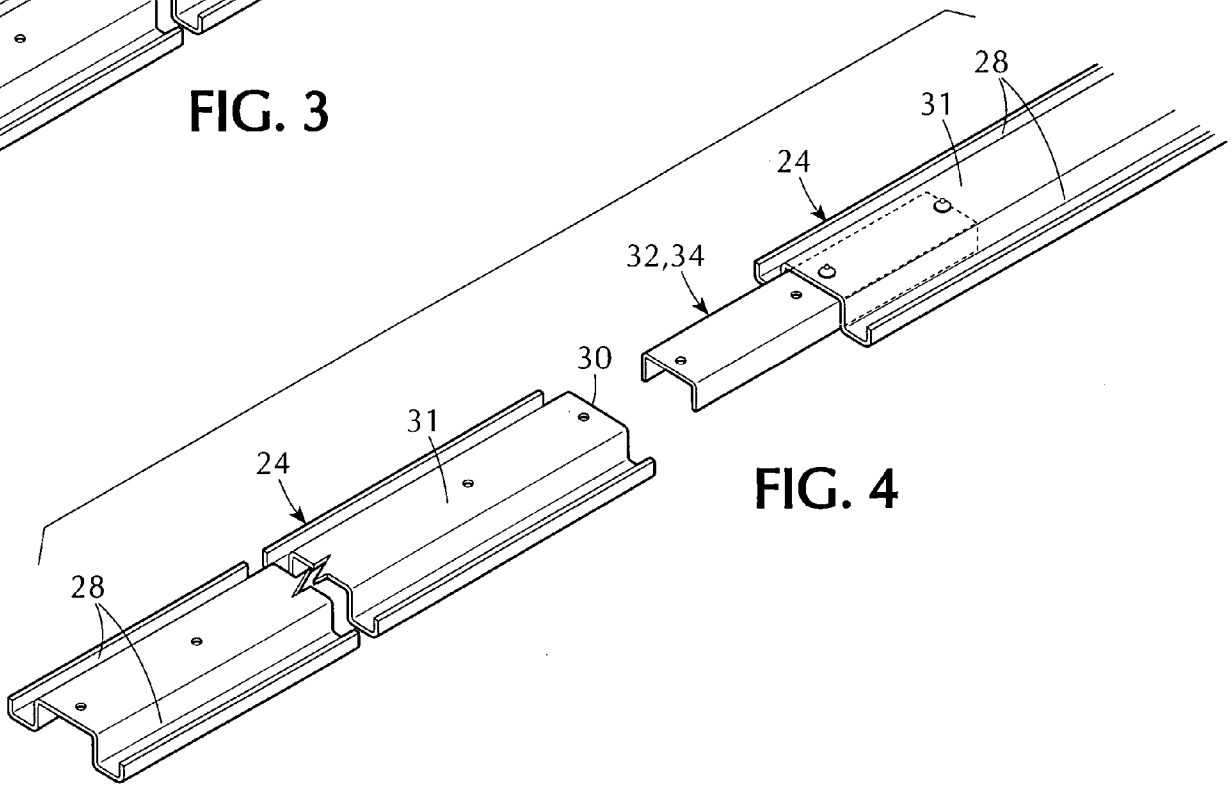
FIG. 4 is a diagrammatic perspective view of the area generally enclosed by the dotted curve identified by ARROW 4 in FIG. 1A of a pair of rail sections being joined together end-to-end by a connecting member of the modular tenter frame of the embodiments of the present invention.

As shown in FIG. 4, which is a diagrammatic perspective view of the area generally enclosed by the dotted curve identified by ARROW 4 in FIG. 1A of a pair of rail sections being joined together end-to-end by a connecting member of the modular tenter frame of the embodiments of the present invention, a pair of rail sections 24 are joined together end-to-end by a connecting member 32.

The connecting member 32 is an inverted U-channel 34 fitted into the space 30 between the pair of recessed tracks 28 in each of the pair of rail sections 24 to maintain a low profile without protrusions of the longitudinally connected pair of rail sections 24.

Figure 5:
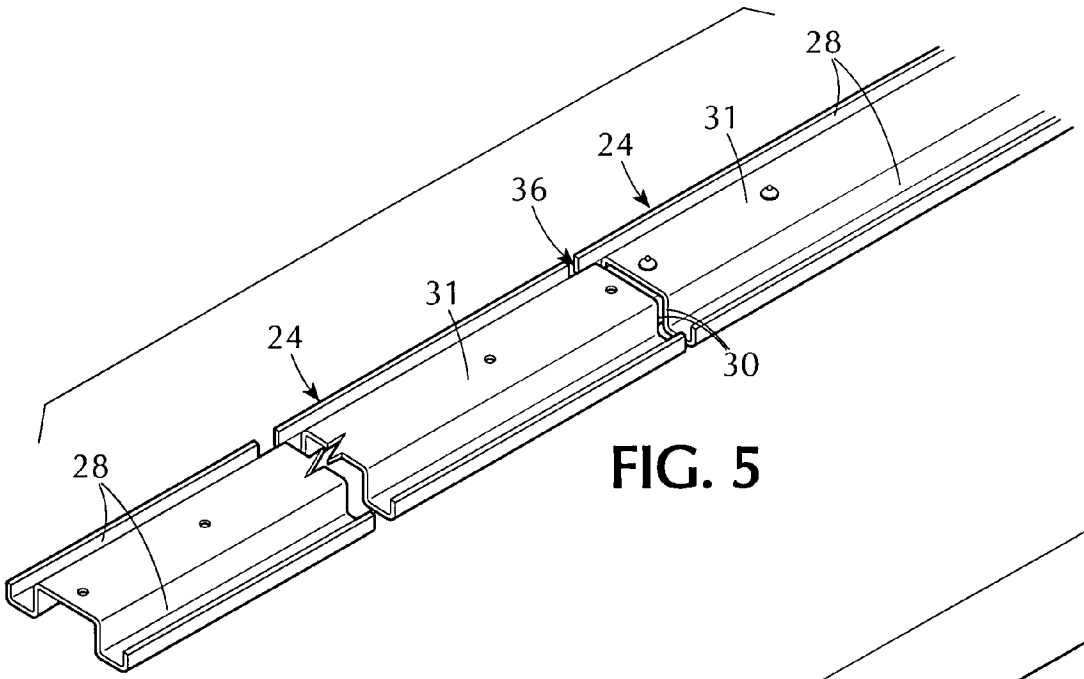
FIG. 5 is a diagrammatic perspective view of the area generally enclosed by the dotted curve identified by ARROW 5 in FIG. 1A of a pair of rail sections being pivotally joined together end-to-end by a hinge member of the modular tenter frame of the embodiments of the present invention.

As shown in FIG. 5, which is a diagrammatic perspective view of the area generally enclosed by the dotted curve identified by ARROW 5 in FIG. 1A of a pair of rail sections being pivotally joined together end-to-end by a hinge member of the modular tenter frame of the embodiments of the present invention, a pair of rail sections 24 are pivotally joined together end-to-end by a hinge member 36.

The hinge member 36 is fitted into the space 30 between the pair of recessed tracks 28 in each of the pair of rail sections 24 to maintain a low profile without protrusions of the longitudinally hingedly connected pair of rail sections 24 and allow the pair of rail sections 24 to come closer to each other or away from each other for following the edges of the open width tubular knit web 16, for example, so that the edges of the open width tubular knit web 16 can be deposited on the pins 14 fastened to the chain 12 thereby allowing the open width tubular knit web 16 to be stretched to the parallel section of the pair of rail sections 24 where the open width tubular knit web 16 may be steamed or heated in the drying oven 18 to set the width of the open width tubular knit web 16 and/or transported to the compressive treating station 22 to reduce the length shrinkage at a predetermined set width.

Figure 6:
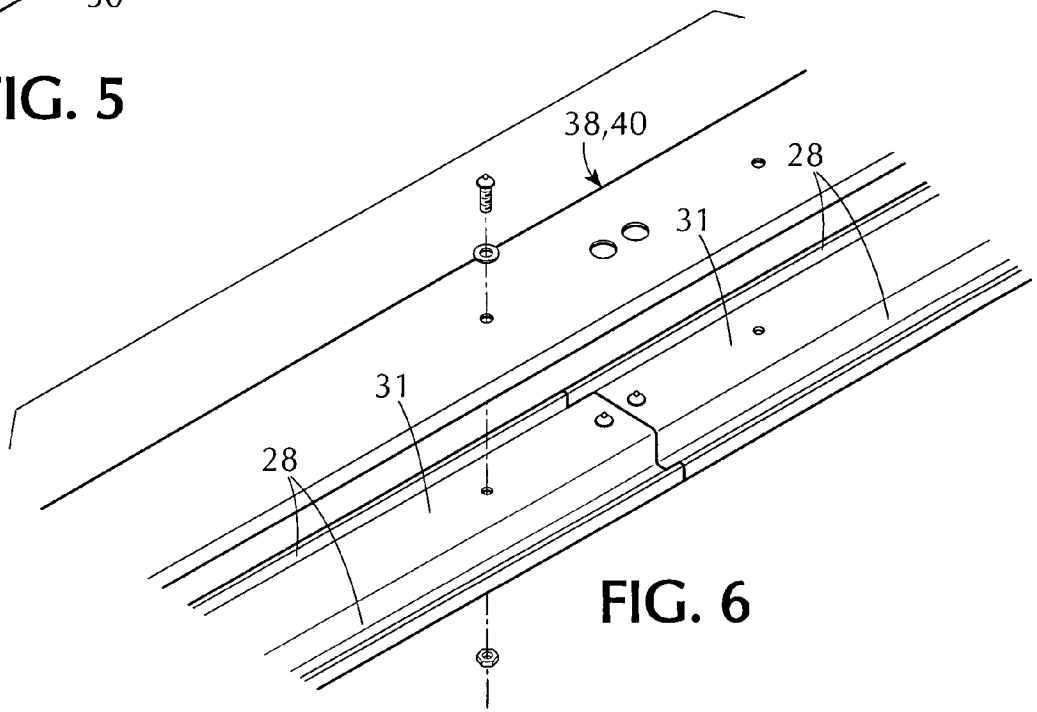
FIG. 6 is a diagrammatic perspective view of the area generally enclosed by the dotted curve identified by ARROW 6 in FIG. 1A of a plurality of rail sections joined together end-to-end and being covered by a cover member of the modular tenter frame of the embodiments of the present invention.

As shown in FIG. 6, which is a diagrammatic perspective view of the area generally enclosed by the dotted curve identified by ARROW 6 in FIG. 1A of a plurality of rail sections joined together end-to-end and being covered by a cover member of the modular tenter frame of the embodiments of the present invention, at least a pair of rail sections 24 are joined together end-to-end by the connecting member 32 and then covered by a cover member 38.

The cover member 38 is one-piece and is an inverted U-channel 40 fitted onto the web 31 of each rail section 24 and into the pair of recessed tracks 28 in an associated rail section 24.

C. The Configuration of the Pinning Brush Assembly 42.

Figure 7:
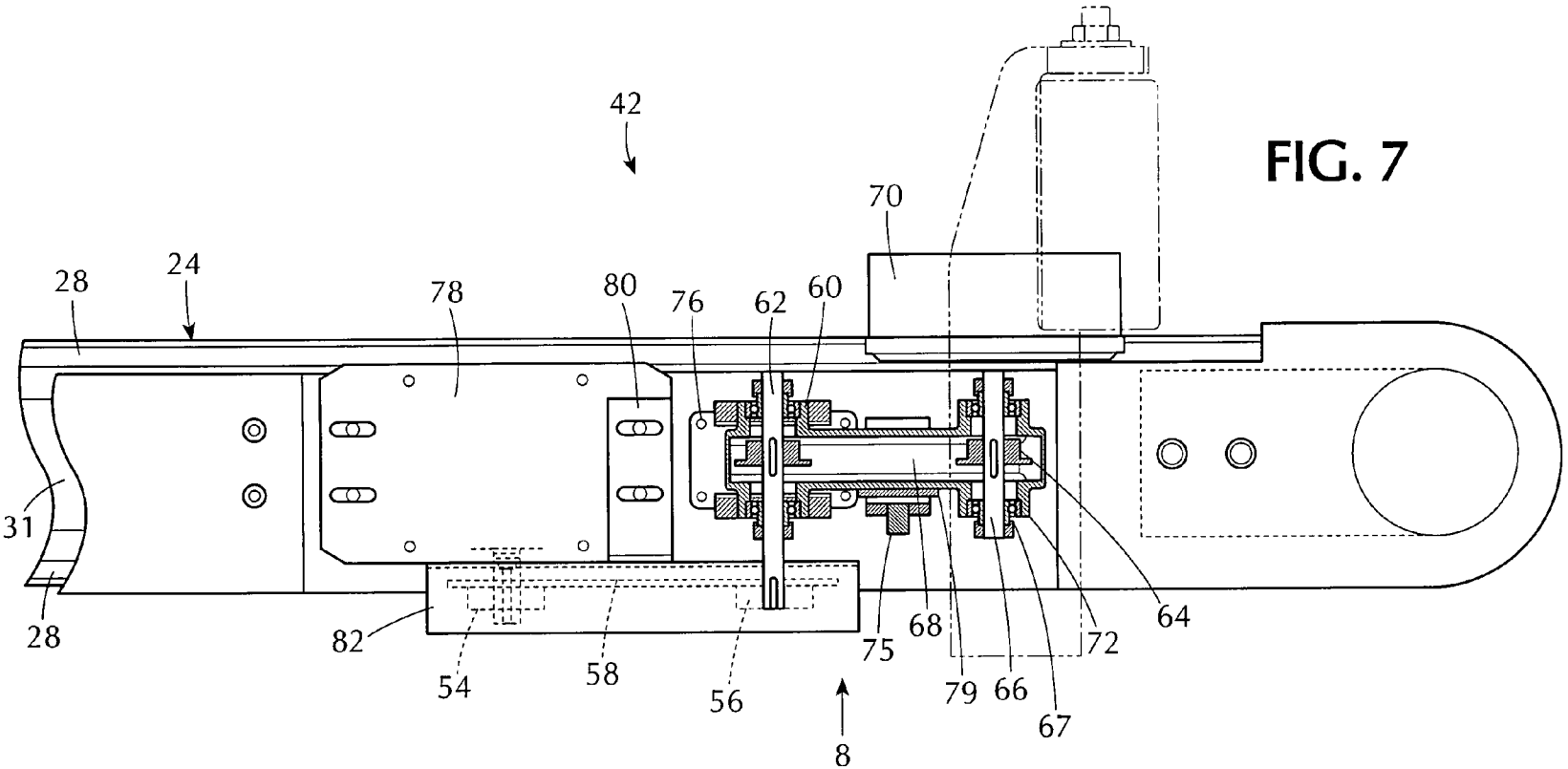
FIG. 7 is a diagrammatic top plan view of the area generally enclosed by the dotted curve identified by ARROW 7 in FIGS. 1B and 2B of the pinning brush assembly of the modular tenter frame of the embodiments of the present invention.
Figure 8:
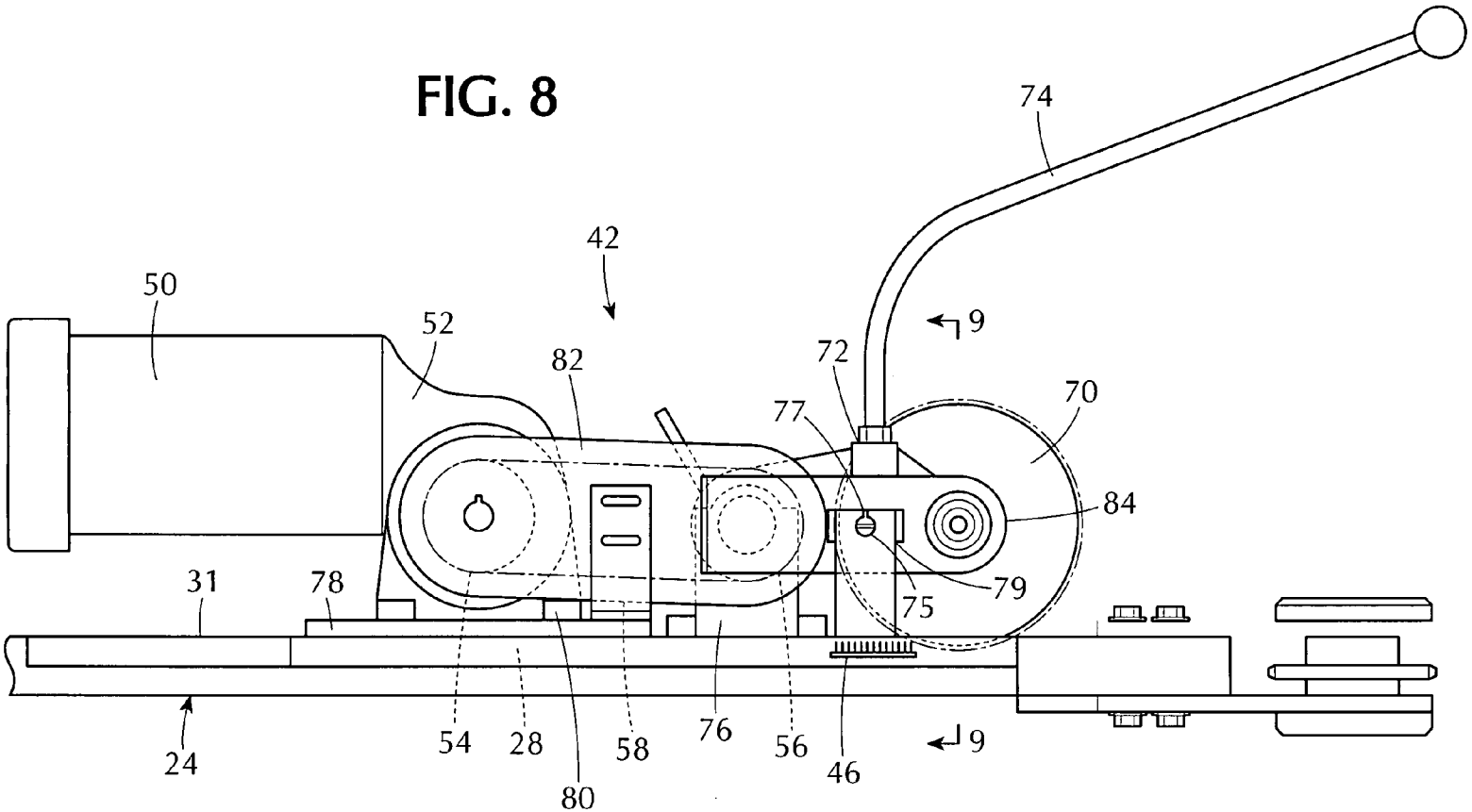
FIG. 8 is a diagrammatic side elevational view taken generally in the direction of ARROW 8 in FIG. 7.
Figure 9:
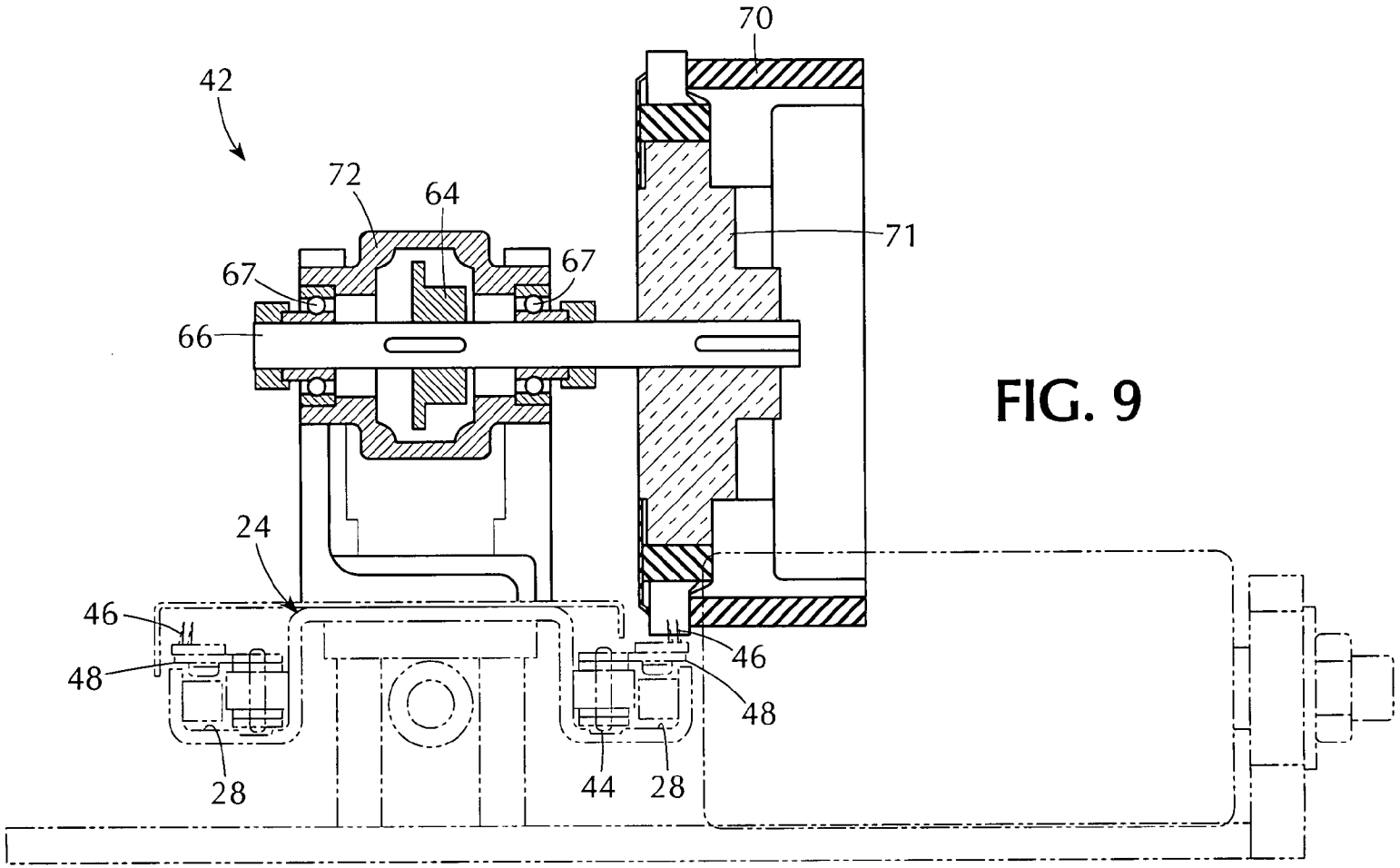
FIG. 9 is an enlarged diagrammatic cross sectional view taken along LINE 9-9 in FIG. 8.

As shown in FIGS. 7-9, which are, respectively, a diagrammatic top plan view of the area generally enclosed by the dotted curve identified by ARROW 7 in FIGS. 1B and 2B of the pinning brush assembly of the modular tenter frame of the embodiments of the present invention, a diagrammatic side elevational view taken generally in the direction of ARROW 8 in FIG. 7, and an enlarged diagrammatic cross sectional view taken along LINE 9-9 in FIG. 8, the modular tenter frame rail 10 further comprises a pinning brush assembly 42.

The pinning brush assembly 42 comprises a first sprocket chain 44, pins 46, and a bracket 48. The first sprocket chain 44 of the pinning brush assembly 42 rides continuously in the pair of recessed tracks 28 in an associated rail section 24. The pins 46 of the pinning brush assembly 42 are affixed to and move with the first sprocket chain 44 of the pinning brush assembly 42 via the bracket 48 of the pinning brush assembly 42 and extend upwardly for engaging an associated edge of the open width tubular knit web 16.

The pinning brush assembly 42 further comprises a motor 50 and right angle gearing 52. The motor 50 of the pinning brush assembly 42 has an output and is affixed rearwardly facing to the web 31 of the associated each rail section 24. The right angle gearing 52 of the pinning brush assembly 42 is operatively connected to the motor 50 of the pinning brush assembly 42 and diverts the rearwardly facing output of the motor 50 of the pinning brush assembly 42 inwardly to deposit the fabric on to sprocket chain 44 of the pinning brush assembly 42 when the motor 50 of the pinning brush assembly 42 activates.

The pinning brush assembly 42 further comprises a first sprocket gear 54. The first sprocket gear 54 of the pinning brush assembly 42 is connected to and rotates with the right angle gearing 52 of the pinning brush assembly 42.

The pinning brush assembly 42 further comprises a second sprocket gear 56. The second sprocket gear 56 of the pinning brush assembly 42 is disposed rearwardly of and in line with the first sprocket gear 54 of the pinning brush assembly 42.

The pinning brush assembly 42 further comprises a second sprocket chain 58. The second sprocket chain 58 of the pinning brush assembly 42 winds around the first sprocket gear 54 of the pinning brush assembly 42 and the second sprocket gear 56 of the pinning brush assembly 42 and causes the second sprocket gear 56 of the pinning brush assembly 42 to rotate when the first sprocket gear 54 of the pinning brush assembly 42 is rotated by the motor 50 of the pinning brush assembly 42 via the right angle gearing 52 of the pinning brush assembly 42.

The pinning brush assembly 42 further comprises a third sprocket gear 60 and a jack shaft 62. The third sprocket gear 60 of the pinning brush assembly 42 is parallel to and operatively connected to and caused to rotate with the second sprocket gear 56 of the pinning brush assembly 42 by the jack shaft 62 of the pinning brush assembly 42.

The pinning brush assembly 42 further comprises a fourth sprocket gear 64 and a brush shaft 66. The fourth sprocket gear 64 of the pinning brush assembly 42 is disposed rearwardly of and in line with the third sprocket gear 60 of the pinning brush assembly 42 and has the brush shaft 66 of the pinning brush assembly 42 extending perpendicularly therethrough and rotating on ball bearings 67.

The pinning brush assembly 42 further comprises a third sprocket chain 68. The third sprocket chain 68 of the pinning brush assembly 42 winds around the third sprocket gear 60 of the pinning brush assembly 42 and the fourth sprocket gear 64 of the pinning brush assembly 42 and causes the fourth sprocket gear 64 of the pinning brush assembly 42 to rotate when the first sprocket gear 54 of the pinning brush assembly 42 is rotated by the motor 50 of the pinning brush assembly 42 via the right angle gearing 52 of the pinning brush assembly 42.

The pinning brush assembly 42 further comprises a rubber-covered pinning wheel 70. The rubber-covered pinning wheel 70 of the pinning brush assembly 42 is connected to and rotates with the brush shaft 66 of the pinning brush assembly 42 via a hub 71 and is caused to rotate when the first sprocket gear 54 of the pinning brush assembly 42 is rotated by the motor 50 of the pinning brush assembly 42 via the right angle gearing 52 of the pinning brush assembly 42.

The pinning brush assembly 42 further comprises a brush arm 72 and a handle 74. The brush arm 72 of the pinning brush assembly 42 is operatively connected to the brush shaft 66 of the pinning brush assembly 42 by a ball plunger 75, a spring plunger bracket 77, and a detent stop 79, and is operated by the handle 74 of the pinning brush assembly 42 extending upwardly and rearwardly therefrom.

The pinning brush assembly 42 further comprises a support 76. The support 76 of the pinning brush assembly 42 is affixed to the web 31 of the associated rail section 24 via a sub-plate 78 and supports the brush arm 72 of the pinning brush assembly 42.

The pinning brush assembly 42 further comprises a guard mounting bracket 80. The guard mounting bracket 80 of the pinning brush assembly 42 is affixed on the sub-plate 78 of the pinning brush assembly 42.

The pinning brush assembly 42 further comprises a guard 82. The guard 82 of the pinning brush assembly 42 is attached to the guard mounting bracket 80 of the pinning brush assembly 42 and encloses and isolates the second sprocket chain 58 of the pinning brush assembly 42, the first sprocket gear 54 of the pinning brush assembly 42, and the second sprocket gear 56 of the pinning brush assembly 42.

The pinning brush assembly 42 further comprises an end cover 84. The end cover 84 of the pinning brush assembly 42 encloses and isolates the brush arm 72 of the pinning brush assembly 42.

D. The conclusions.

It will be understood that each of the elements described above or two or more together may also find a useful application in other types of constructions differing from the types described above.

While the embodiments of the present invention have been illustrated and described as embodied in a modular tenter frame rail, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A modular tenter frame for guiding a pair of chains with pins through a predetermined path to transport an open width tubular knit web having edges and a width through a drying oven and/or a steaming station to a compressive treating station to improve quality of the open width tubular knit web, said frame comprising:

a) rail section; and b) a cover member;

wherein said rail section is for guiding an associated chain with the pins through the predetermined path to transport the open width tubular knit web through the drying oven and/or the steaming station to the compressive treating station to improve the quality of the open width tubular knit web;

wherein said rail section has a pair of recessed tracks;

wherein said pair of recessed tracks in said rail section are longitudinal;

wherein said pair of recessed tracks in said rail section face a same direction;

wherein said pair of recessed tracks in said rail section are spaced-apart from each other by a space defined by a web; and wherein said cover member covers at least a pair of rail sections joined together end-to-end.

2. The frame of claim 1, wherein said pair of recessed tracks in said rail section are of suitable widths for first guiding the chain in one direction and then guiding the chain in another direction being opposite to the one direction.

3. The frame of claim 1, wherein said space between said pair of recessed tracks in said rail section is longitudinal; and wherein said space between said pair of recessed tracks in said rail section is recessed in a direction opposite to that of said pair of recessed tracks in said rail section for permitting air nozzles in the drying oven to be placed top and bottom of said rail section in close proximity to said rail section to effectively blow hot air on both sides of the open width tubular knit web carried by the chain traveling in an associated recessed track in said rail section for efficient drying.

4. The frame of claim 1, wherein said rail section is a plate;

wherein said plate of said rail section is made out of steel; and wherein said rail section is a relatively short section joined to other rail sections end-to-end to form a continuous track as long as required.

5. The frame of claim 1, further comprising a connecting member; and wherein said connecting member joins a pair of rail sections together end-to-end to form a longitudinally connected pair of rail sections.

6. The frame of claim 5, wherein said connecting member is an inverted U-channel; and wherein said inverted U-shaped channel of said connecting member is fitted into said space between said pair of recessed tracks in each of said pair of rail sections to maintain a low profile without protrusions of said longitudinally connected pair of rail sections.

7. The frame of claim 5, further comprising a hinge member; and wherein said hinge member pivotally joins a pair of rail sections together end-to-end.

8. The frame of claim 7, wherein said hinge member is fitted into said space between said pair of recessed tracks in each of said pair of rail sections to maintain a low profile without protrusions of said longitudinally hingedly connected pair of rail sections and allow said pair of rail sections to come closer to each other or away from each other for following the edges of the open width tubular knit web so that the edges of the open width tubular knit web are deposited on the pins fastened to the chain thereby allowing the open width tubular knit web to be stretched to a parallel section of said pair of rail sections where the open width tubular knit web is steamed or heated in the drying oven to set the width of the open width tubular knit web and/or transported to the compressive treating station to reduce length shrinkage at a predetermined set width.

9. The frame of claim 1, wherein said cover member is one-piece;

wherein said cover member is an inverted U-channel; and wherein said inverted U-channel of said cover member is fitted onto said web of each rail section and into said pair of recessed tracks in an associated rail section.

10. The frame of claim 1, further comprising a pinning brush assembly.

11. The frame of claim 10, wherein said pinning brush assembly comprises a first sprocket chain;

wherein said pinning brush assembly comprises pins;

wherein said pinning brush assembly comprises a bracket;

wherein said first sprocket chain of said pinning brush assembly rides continuously in said pair of recessed tracks in an associated rail section;

wherein said pins of said pinning brush assembly are affixed to said first sprocket chain of said pinning brush assembly via said bracket of said pinning brush assembly;

wherein said pins of said pinning brush assembly move with said first sprocket chain of said pinning brush assembly; and wherein said pins of said pinning brush assembly extend upwardly for engaging an associated edge of the open width tubular knit web.

12. The frame of claim 11, wherein said pinning brush assembly comprises a motor;

wherein said pinning brush assembly comprises right angle gearing;

wherein said motor of said pinning brush assembly has a rearwardly facing output;

wherein said motor of said pinning brush assembly is affixed rearwardly facing to said web of an associated rail section;

wherein said right angle gearing of said pinning brush assembly is operatively connected to said motor of said pinning brush assembly; and wherein said right angle gearing of said pinning brush assembly diverts said rearwardly facing output of said motor of said pinning brush assembly inwardly for depositing the fabric on said first sprocket chain of said pinning brush assembly when said motor of said pinning brush assembly activates.

13. The frame of claim 12, wherein said pinning brush assembly comprises a first sprocket gear;

wherein said first sprocket gear of said pinning brush assembly is connected to said right angle gearing of said pinning brush assembly; and wherein said first sprocket gear of said pinning brush assembly rotates with said right angle gearing of said pinning brush assembly.

14. The frame of claim 13, wherein said pinning brush assembly comprises a second sprocket gear;

wherein said second sprocket gear of said pinning brush assembly is disposed rearwardly of said first sprocket gear of said pinning brush assembly; and wherein said second sprocket gear of said pinning brush assembly is disposed in line with said first sprocket gear of said pinning brush assembly.

15. The frame of claim 14, wherein said pinning brush assembly comprises a second sprocket chain;

wherein said second sprocket chain of said pinning brush assembly winds around said first sprocket gear of said pinning brush assembly and said second sprocket gear of said pinning brush assembly; and wherein said second sprocket chain of said pinning brush assembly causes said second sprocket gear of said pinning brush assembly to rotate when said first sprocket gear of said pinning brush assembly is rotated by said motor of said pinning brush assembly via said right angle gearing of said pinning brush assembly.

16. The frame of claim 15, wherein said pinning brush assembly comprises a third sprocket gear;

wherein said pinning brush assembly comprises a jack shaft;

wherein said third sprocket gear of said pinning brush assembly is parallel to said second sprocket gear of said pinning brush assembly;

wherein said third sprocket gear of said pinning brush assembly is operatively connected to said second sprocket gear of said pinning brush assembly by said jack shaft of said pinning brush assembly; and wherein said third sprocket gear of said pinning brush assembly is caused to rotate with said second sprocket gear of said pinning brush assembly by said jack shaft of said pinning brush assembly.

17. The frame of claim 16, wherein said pinning brush assembly comprises a fourth sprocket gear;

wherein said pinning brush assembly comprises a brush shaft;

wherein said fourth sprocket gear of said pinning brush assembly is disposed rearwardly of said third sprocket gear of said pinning brush assembly;

wherein said fourth sprocket gear of said pinning brush assembly is disposed in line with said third sprocket gear of said pinning brush assembly; and wherein said fourth sprocket gear of said pinning brush assembly has said brush shaft of said pinning brush assembly extending perpendicularly therethrough.

18. The frame of claim 17, wherein said brush shaft of said pinning brush assembly rotates on ball bearings.

19. The frame of claim 17, wherein said pinning brush assembly comprises a third sprocket chain;

wherein said third sprocket chain of said pinning brush assembly winds around said third sprocket gear of said pinning brush assembly and said fourth sprocket gear of said pinning brush assembly; and wherein said third sprocket chain of said pinning brush assembly causes said fourth sprocket gear of said pinning brush assembly to rotate when said first sprocket gear of said pinning brush assembly is rotated by said motor of said pinning brush assembly via said right angle gearing of said pinning brush assembly.

20. The frame of claim 17, wherein said pinning brush assembly comprises a rubber-covered pinning wheel;

wherein said rubber-covered pinning wheel of said pinning brush assembly is connected to said brush shaft of said pinning brush assembly via a hub;

wherein said rubber-covered pinning wheel of said pinning brush assembly rotates with said brush shaft of said pinning brush assembly; and wherein said rubber-covered pinning wheel of said pinning brush assembly is caused to rotate when said first sprocket gear of said pinning brush assembly is rotated by said motor of said pinning brush assembly via said right angle gearing of said pinning brush assembly.

21. The frame of claim 17, wherein said pinning brush assembly comprises a brush arm;

wherein said pinning brush assembly comprises a handle;

wherein said brush arm of said pinning brush assembly is operatively connected to said brush shaft of said pinning brush assembly by a ball plunger, a spring plunger bracket, and a detent stop; and wherein said brush arm of said pinning brush assembly is operated by said handle of said pinning brush assembly extending therefrom.

22. The frame of claim 21, wherein said pinning brush assembly comprises a support;

wherein said support of said pinning brush assembly is affixed to said web of an associated rail section via a sub-plate; and wherein said support of said pinning brush assembly supports said brush arm of said pinning brush assembly.

23. The frame of claim 22, wherein said pinning brush assembly comprises a guard mounting bracket; and wherein said guard mounting bracket of said pinning brush assembly is affixed on said sub-plate of said pinning brush assembly.

24. The frame of claim 23, wherein said pinning brush assembly comprises a guard;

wherein said guard of said pinning brush assembly is attached to said guard mounting bracket of said pinning brush assembly;

wherein said guard of said pinning brush assembly encloses said second sprocket chain of said pinning brush assembly, said first sprocket gear of said pinning brush assembly, and said second sprocket gear of said pinning brush assembly; and wherein said guard of said pinning brush assembly isolates said second sprocket chain of said pinning brush assembly, said first sprocket gear of said pinning brush assembly, and said second sprocket gear of said pinning brush assembly.

25. The frame of claim 21, wherein said pinning brush assembly comprises an end cover;

wherein said end cover of said pinning brush assembly encloses said brush arm of said pinning brush assembly; and wherein said end cover of said pinning brush assembly isolates said brush arm of said pinning brush assembly.

* * * * *